US006056173A

United States Patent [19]

Gillespie

[11] Patent Number: 6,056,173

[45] Date of Patent: May 2, 2000

[54] HOLDING DEVICE

[75] Inventor: Michael J. Gillespie, Chelsea, Mich.

[73] Assignee: Jodon Engineering Associates, Inc., Ann Arbor, Mich.

[21] Appl. No.: 09/032,886

[22] Filed: Mar. 2, 1998

[51] Int. Cl.[7] ..... A45F 5/00

[52] U.S. Cl. ..... 224/247; 224/269; 224/250; 224/674; 224/651; 224/194; 24/3.3; 24/3.11; 24/3.12; 24/3.13; 24/265 EC

[58] Field of Search ..... 224/191, 194, 224/220, 674, 247, 248, 250, 254, 269, 650, 651; 24/3.2, 3.3, 3.4, 265 EC, 3.11, 3.12, 3.13; 473/551

[56] References Cited

U.S. PATENT DOCUMENTS

| | | | |
|---|---|---|---|
| 530,215 | 12/1894 | Weiss | 224/220 |
| 2,169,080 | 8/1939 | Clark . | |
| 2,487,339 | 11/1949 | Kindlund . | |
| 3,107,405 | 10/1963 | Emmer . | |
| 4,779,778 | 10/1988 | Nixon, II . | |
| 4,845,650 | 7/1989 | Meade et al. | 224/269 X |
| 4,847,729 | 7/1989 | Hee . | |
| 4,991,236 | 2/1991 | Pritchett . | |
| 5,092,018 | 3/1992 | Seron | 24/3.2 X |
| 5,144,695 | 9/1992 | Schweizer . | |
| 5,398,855 | 3/1995 | Schaiewitz | 24/3.4 X |
| 5,459,903 | 10/1995 | Treacy . | |
| 5,460,346 | 10/1995 | Hirsch . | |
| 5,465,466 | 11/1995 | Napier | 24/3.13 X |
| 5,600,873 | 2/1997 | May | 24/3.2 |
| 5,896,623 | 4/1999 | Martin | 24/3.13 X |

FOREIGN PATENT DOCUMENTS

| | | | |
|---|---|---|---|
| 104279 | 3/1917 | United Kingdom | 224/194 |

*Primary Examiner*—Gregory M. Vidovich
*Attorney, Agent, or Firm*—Reising, Ethington, Barnes, Kisselle, Learman & McCulloch P.C.

[57] ABSTRACT

A holding device comprises a clip, and a flexible cord. The cord is looped upon itself and its ends are received in a trough on a stem of the clip. The trough has laterally spaced tabs which are crimped over the ends of the cord to secure the cord to the clip. A metal tube is crimped over the trough and the cord ends, and shrink tubing is fitted over the metal tube.

8 Claims, 2 Drawing Sheets

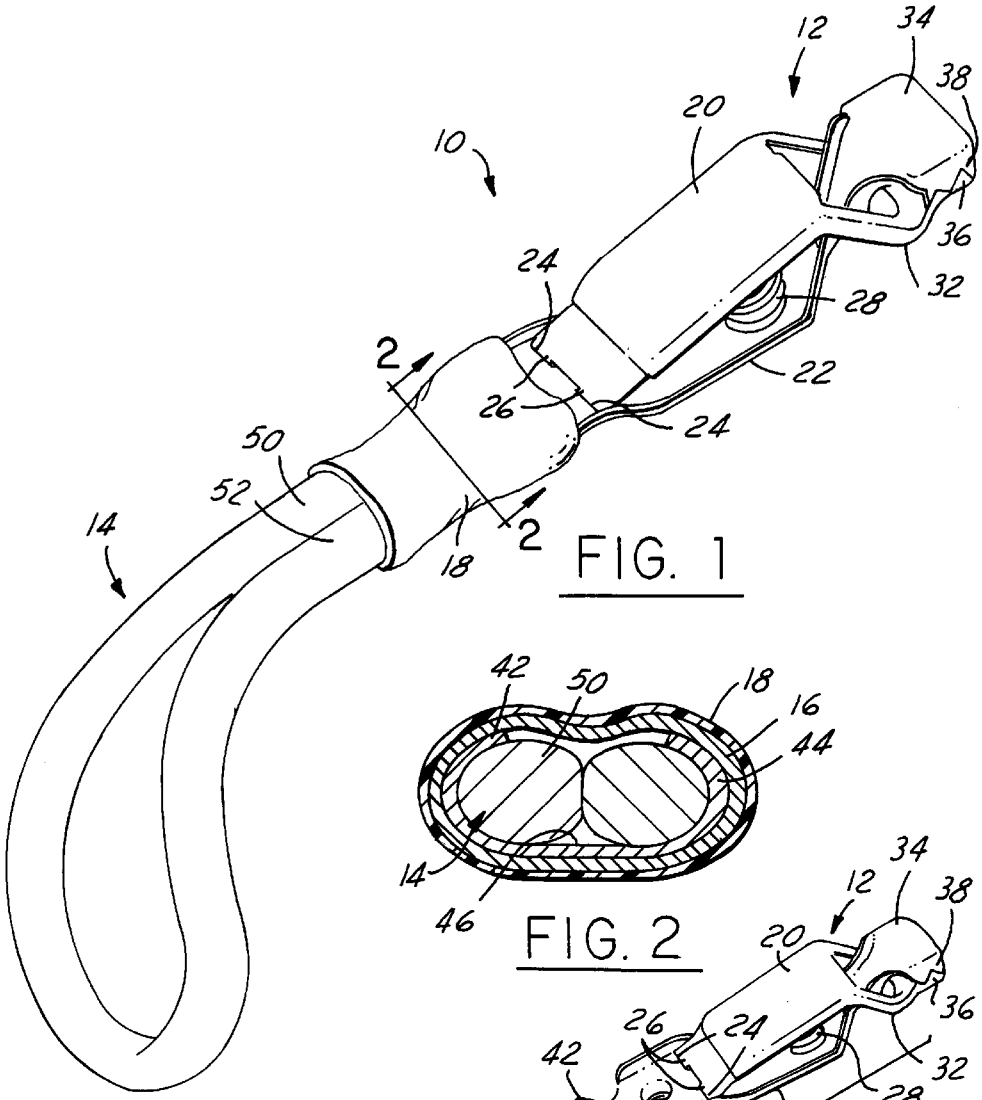
FIG. 1
FIG. 2
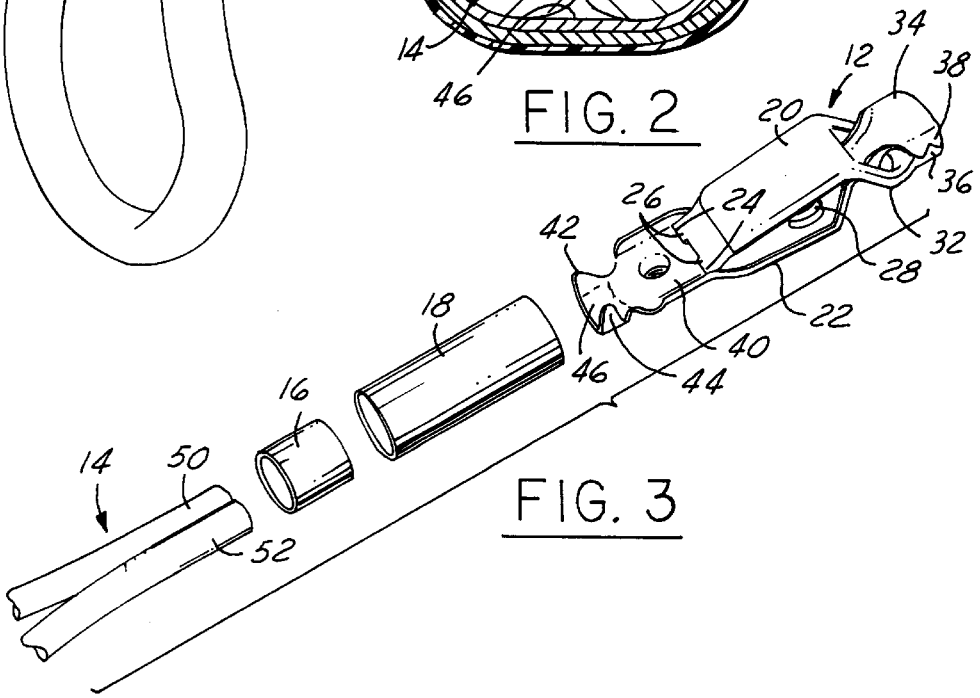
FIG. 3

HOLDING DEVICE

FIELD OF INVENTION

This invention relates generally to holding devices and more particularly to a holding device for personal use.

BACKGROUND AND SUMMARY OF THE INVENTION

The device of this invention is intended for use by persons engaged in outdoor activities including recreational activities such as camping or hiking. It may be used for clipping an item onto a person's belt or a metal ring of a back pack, for example. It can be used to hold items such as wet clothing, hunting accessories or anything that requires easy access. It may also be used by construction workers, for example, to hold construction supplies, tools or plans.

The device may, for example, comprise an alligator-type clip having a length of cord affixed thereto. The cord may be of any flexible material such as nylon. The cord may comprise a single length that is looped onto itself with the free ends crimped or otherwise fastened to the end of the alligator clip. The cord may be either elastic or inelastic.

More specifically, the clip may have a stem formed of a bendable metal having integral upstanding tabs crimped over the end portions of the cord to fasten the cord to the stem. A metal tube may be crimped over the end portions of the cord and over the tabs. If desired, shrink tubing may be fitted over the metal tube to cover the joint between the cord and the clip and to provide a finished appearance.

One object of this invention is to provide a holding device having the foregoing features and capabilities.

Another object of the invention is to provide a holding device which is composed of a relatively few simple parts, is rugged and durable in use, and is capable of being inexpensively manufactured and assembled.

These and other objects, features and advantages of the invention will become more apparent as the following description proceeds, especially when considered with the accompanying drawings.

BRIEF DESCRIPTION OF THE DRAWINGS

FIG. 1 is a perspective view of a holding device constructed in accordance with the invention.

FIG. 2 is a sectional view taken on the line 2—2 in FIG. 1.

FIG. 3 is an exploded view in perspective of the device shown in FIG. 1.

DETAILED DESCRIPTION OF THE PREFERRED EMBODIMENT

Figure 4:
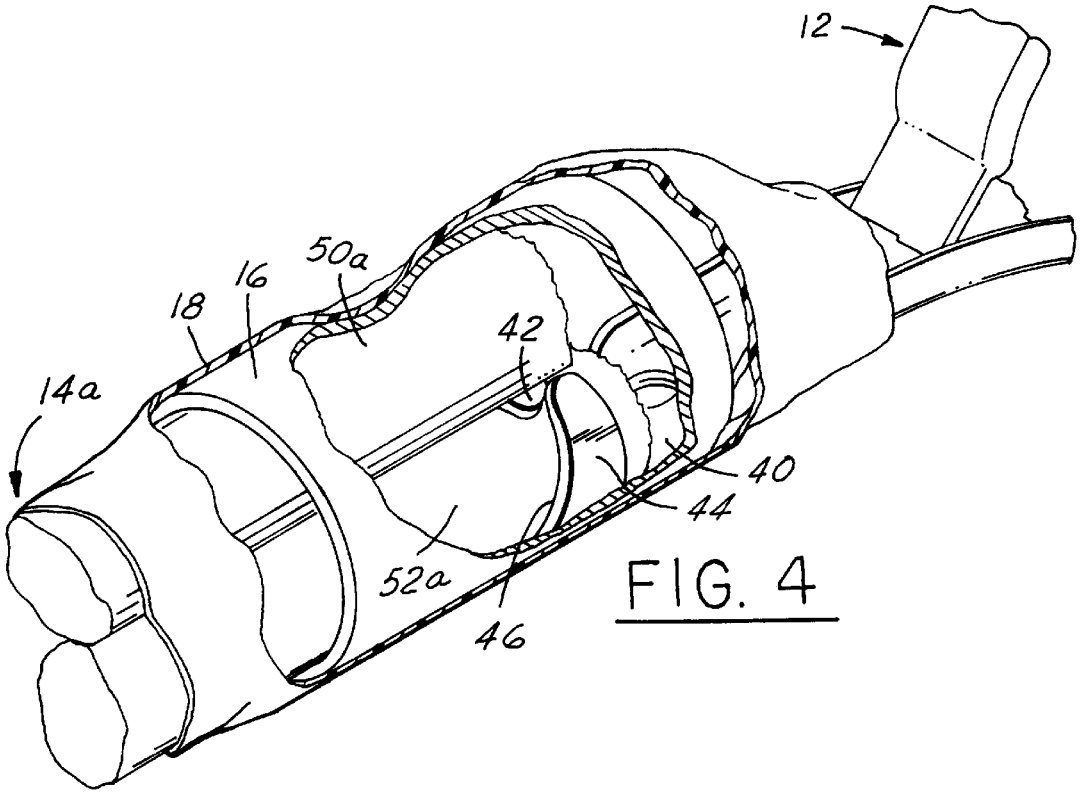
FIG. 4 is an enlarged fragmentary perspective view of a modification, with parts broken away and in section.

Referring now more particularly to the drawings, and especially to FIGS. 1–3, the holding device 10 there shown comprises a clip 12, a length of cord 14, a metal tube 16 and shrink tubing 18.

The clip 12 is an alligator-type clip having elongated clamp jaws 20 and 22. The jaw 20 has slots 24 near the rear end which receive tongues 26 on the corresponding end of the jaw 22 to provide a pivotal connection between the jaws. The jaws are urged apart by a compression coil spring 28. The front end portion of jaw 22 extends through an opening in the jaw 20. Heads 32 and 34 on the front ends of the jaws have teeth 36 and 38 which cooperate to grip an item desired to be held. The jaws can be squeezed together by finger pressure against the force of the spring 28 to spread apart the teeth of the jaws and release an item.

The clip has a stem 40 at the rear end which is an integral extension of the jaw 20. The stem 40 is formed with a pair of laterally spaced upstanding tabs 42 and 44 which together with the base of the stem define a channel or trough 46. The stem, and preferably the entire clip 12, is formed of a suitable bendable metal.

The cord 14 is a length of elastic or inelastic flexible material made, for example, of a relatively tough nylon. The cord is doubled over or looped upon itself and has free ends 50 and 52. The free ends of the cord lie side-by-side within the trough 46 formed on the stem of the clip.

As shown in FIG. 2, the tabs 42 and 44 are crimped laterally inwardly and bent over upon the free ends 50 and 52 of the cord to capture the free ends within the trough and thus securely fasten the cord to the clip.

The tube 16 is preferably made of a bendable metal and is sleeved over the trough 46 formed on the stem 40 at the end of the clip and over the ends 50 and 52 of the cord which are clamped within the trough 46 by the tabs 42 and 44. The tube is then crimped or compressed down upon the stem and upon the tabs 42 and 44 and cord ends 50 and 52 clamped within the trough 46 to further confine the cord ends within the trough and secure the cord to the clip.

The shrink tubing 18 is preferably made of a suitable plastic material and is sleeved over and covers and embraces the entire connection between the cord ends and the clip, including the stem 40, the trough 46 and tabs 42 and 44, and the metal tube 16 crimped over the trough and cord ends. The shrink tubing 18 is primarily applied for cosmetic purposes to cover the crimp joint and to obscure any creases in the metal tube 16 resulting from the crimping thereof.

FIG. 4 shows a modification of the invention in which a cord 14*a* of larger diameter than the cord 14 is employed, and in which only one end 52*a* of the cord can be fitted within the trough 46 of the stem 40 of the clip. This one end is crimped within the trough by the tabs 42 and 44. The other end 50*a* of the cord extends alongside the first end 52*a* but is outside the trough. The metal tube 16 is crimped over the trough 46 and over both ends 50*a* and 52*a* of the cord even though one cord end 50*a* is outside the trough. The shrink tubing 18 is applied in the same manner as in the embodiment of FIGS. 1–3.

It will be apparent that the device of this invention may be applied to the belt of a person's clothing or to the metal ring of a back pack, for example. The clip may be attached to a person's belt or any part of a person's clothing or to the metal ring of a back pack. Items to be carried can be inserted through the loop of the cord. Conversely, the loop of the cord may have the person's belt threaded through it and the jaws of the clip used to hold items to be carried. The device may also be used by putting the clip through, for example, a ring or belt loop and bringing it back around and through the far end of the cord loop. This approach secures the cord onto the ring or belt loop, and allows the clip to hold an object. Items thus carried are readily available and easily accessible.

What is claimed is:

1. A holding device comprising a clip having a stem, an elongated cord looped upon itself and having first and second end portions disposed side-by-side, and means securing the end portions of said cord to said stem, said means comprises portions of said stem crimped over the end portions of said cord, said portions of said stem comprise laterally spaced tabs, the holding device further including a metal tube crimped over and covering the end portions of said cord and said tabs, and tubing fitted over and covering the end portions of said cord, the tabs, and the metal tube.

2. A holding device comprising a clip having a stem, an elongated flexible cord looped upon itself and having first and second end portions disposed side-by-side, said stem being made of a bendable metal and having a trough including integral, laterally spaced upstanding tabs, said end portions of said cord being received in said trough and said tabs being crimped over the end portions of said cord to fasten the cord to the stem, and a metal tube crimped over and covering the end portions of the cord and the trough including said tabs.

3. A holding device as defined in claim 2, and further including shrink tubing fitting over and covering the end portions of said cord, the trough including said tabs and the metal tube.

4. A holding device according to claim 3, wherein said clip is an alligator-type clip.

5. A holding device comprising a clip having a stem, an elongated cord looped upon itself and having first and second end portions disposed side-by-side, said stem having a trough receiving at least one of said end portions of the cord, and a metal tube crimped over and covering the end portions of said cord and said trough.

6. A holding device as defined in claim 5, wherein one only of said end portions is received in said trough, said stem is made of a bendable material and said trough includes laterally spaced tabs crimped over the end portion of the cord received in said trough.

7. A holding device according to claim 6, and further including shrink tubing fitted over and covering the end portions of said cord, said trough including said tabs and the tube.

8. A holding device according to claim 7, wherein said clip is an alligator-type clip.

* * * * *